US005186657A

United States Patent [19]

Abe

[11] Patent Number: 5,186,657

[45] Date of Patent: Feb. 16, 1993

[54] CONNECTOR

[75] Inventor: Kimihiro Abe, Shizuoka, Japan

[73] Assignee: Yazaki Corporation, Tokyo, Japan

[21] Appl. No.: 899,845

[22] Filed: Jun. 17, 1992

[30] Foreign Application Priority Data

Jun. 19, 1991 [JP] Japan ..... 3-147313

[51] Int. Cl.[5] ..... H01R 13/40

[52] U.S. Cl. ..... 439/595

[58] Field of Search ..... 439/594, 595, 597, 600

[56] References Cited

U.S. PATENT DOCUMENTS 5,057,040 10/1991 Kodama et al. ..... 439/594

5,083,944 1/1992 Pitts ..... 439/595

FOREIGN PATENT DOCUMENTS 61-218081 9/1986 Japan .

*Primary Examiner*—Paula A. Bradley

*Attorney, Agent, or Firm*—Sughrue, Mion, Zinn, Macpeak & Seas

[57] ABSTRACT

In order to prevent a terminal from being incorrectly inserted into a connector housing, a connector according to the present invention comprises a connector housing 2 being formed by molding resin in such a manner that a flexible locking lance 10 for a terminal 3 is protruded from an inner wall of a terminal accommodating chamber 6 formed in the connector housing 2; a stripping hole 21 of the flexible locking lance and a lead-out hole 14 for receiving the end portion of the terminal are provided at the inner end of the terminal accommodating chamber; a guide wall 16 on which the terminal may abut is provided between the stripping hole and the lead-out hole; a stripping groove 17 is formed in the flexible locking lance 10 in such a manner that it is extended longitudinally of the flexible locking lance; and a guide prolongation 18 is protruded from the guide wall in correspondence to the stripping groove.

3 Claims, 3 Drawing Sheets

CONNECTOR

BACKGROUND OF THE INVENTION

This invention relates to a connector which mainly accommodates male terminals, and which is so designed as to prevent the terminals from being incorrectly inserted into the connector housing.

FIG. 4 is a vertical sectional view showing a conventional connector disclosed by Japanese Patent Unexamined Publication No. 218081/1986.

In FIG. 4, reference numeral 24 designates a female connector housing formed by molding synthetic resin; and 25, a male tab terminal accommodated in the female connector housing 24.

The female connector housing 24 is made up of two portions. One of the two portions is a fitting portion 26 provided for a mating male connector (not shown), and the other is an accommodating portion 27 provided for the male tab terminal 25.

FIG. 5 is a perspective view, with part cut away, showing the connector housing 24. In the accommodating portion 27, as shown in FIG. 5, a flexible locking lance 32 is protruded obliquely forwardly from the upper inner wall 29 of a terminal accommodating chamber 28. The flexible locking lance 32 has a locking protrusion 31 which is adapted to engage with a middle shoulder 30 of the male tab terminal 25. Furthermore, a male tab lead-out hole 35 is provided at the inner end of the terminal accommodating chamber 28; that is, it is formed in a partition wall 34 between the terminal accommodating chamber 28 and a mating connector fitting chamber 33 in such a manner that it is communicated with the fitting chamber 33. In addition, a guide wall 39 is formed between the male tab lead-out hole 35 and a stripping hole 36 for the locking lance 32 in such a manner that it has a surface 38 which is sloped downwardly for the male tab (or an electrical contact part) 37.

The connector thus constructed suffers from the following difficulty: When, as shown in FIG. 6, the male tab terminal 25 is obliquely upwardly inserted into the terminal accommodating chamber 28 in the housing 24, the end portion 37*a* of the male tab 37 rides over the guide wall 39 to go into stripping hole 36; that is, the male tab terminal 25 is liable to be incorrectly inserted into the connector housing.

SUMMARY OF THE INVENTION

In view of the foregoing, an object of this invention is to provide a connector with which a terminal can be correctly and positively inserted into a terminal accommodating chamber in a housing of resin.

The foregoing object of the invention has been achieved by the provision of a connector having a connector housing formed by molding resin in such a manner that a flexible locking lance for a terminal is protruded from an inner wall of a terminal accommodating chamber formed in the connector housing, a stripping hole for the flexible locking lance and a lead-out hole for receiving the end portion of the terminal are provided at the inner end of the terminal accommodating chamber, and a guide wall on which the terminal may abut is provided between the stripping hole and the lead-out hole against which the terminal; in which, according to the invention, a stripping groove is formed in the flexible locking lance in such a manner that the stripping groove is extended longitudinally of the flexible locking lance, and a guide prolongation is protruded from the guide wall in correspondence to the stripping groove.

As the stripping groove is formed in the flexible locking lance during resin molding, the guide prolongation can be formed on the guide wall in correspondence to the stripping groove. Even when the terminal is obliquely inserted into the terminal accommodating chamber in the connector housing, the end of the terminal, being caused to abut on the guide prolongation, is smoothly guided into the lead-out hole. Thus, the terminal is correctly inserted into the terminal accommodating chamber at all times.

PREFERRED EMBODIMENTS OF THE INVENTION

Figure 1:
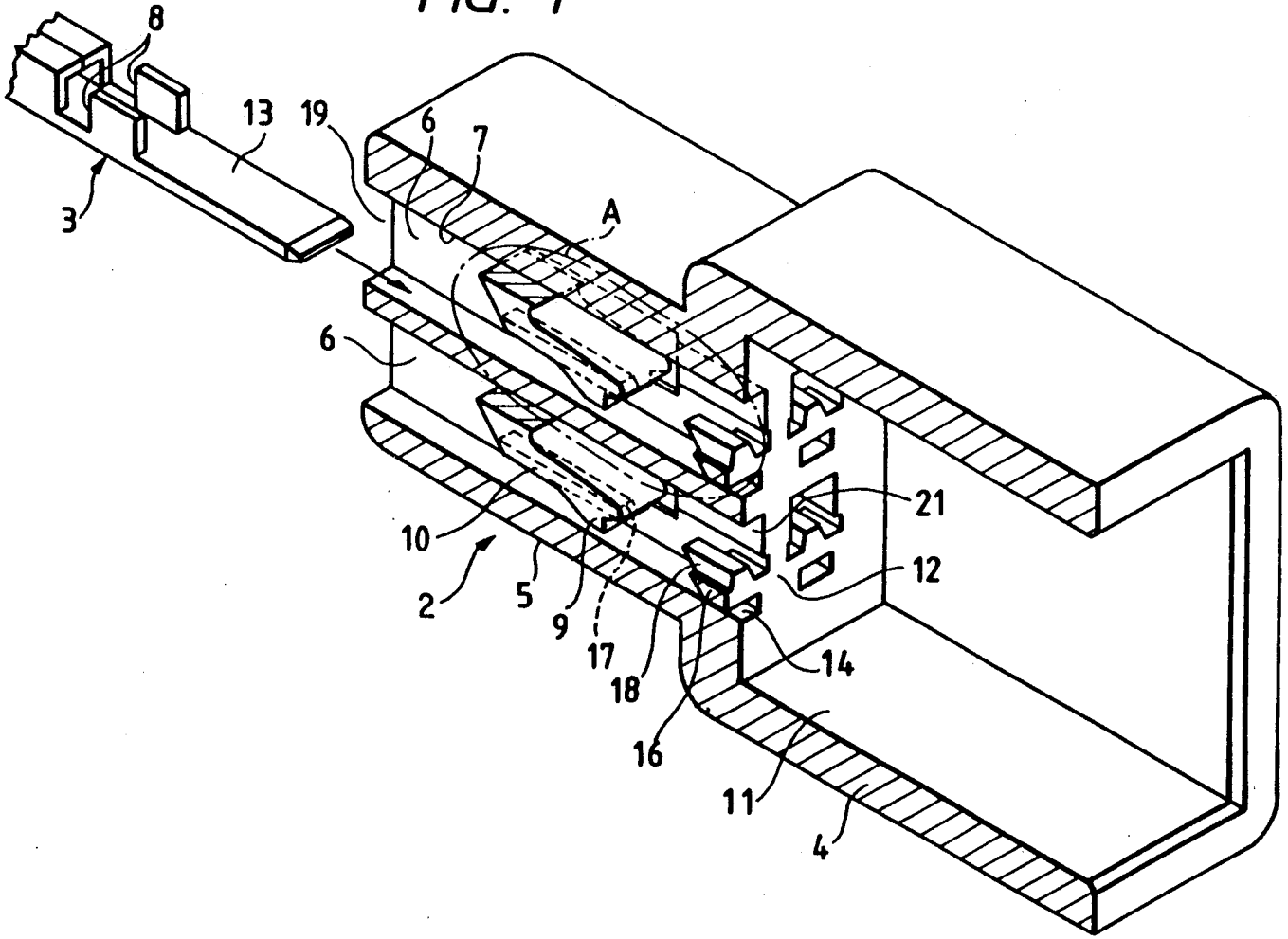
FIG. 1 is an exploded perspective view, with parts cut away, showing an example of a connector according to this invention.
Figure 2:
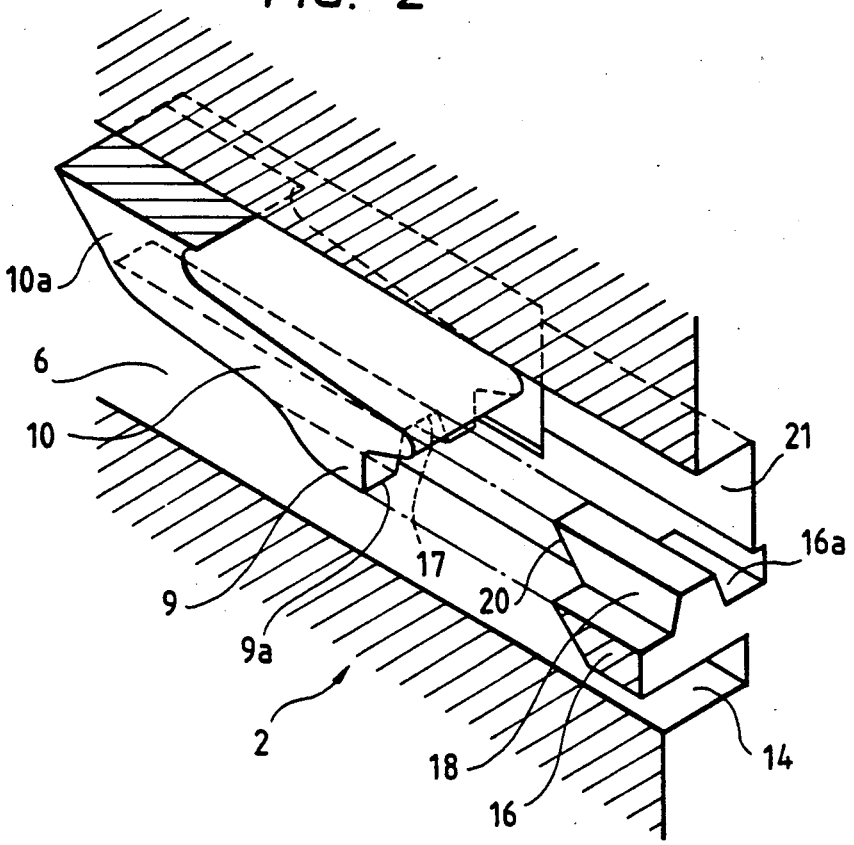
FIG. 2 is an enlarged perspective view of the part "A" of FIG. 1, showing essential components of the connector according to the invention.

FIG. 1 is an exploded perspective, with parts cut away, showing a connector according to this invention, and FIG. 2 is an enlarged diagram of the part "A" of FIG. 1, showing essential components of the connector.

Similarly as in the above-described conventional connection, the connector of the invention comprises: a female connector housing 2 made of synthetic resin; and male tab terminals 3. The connector housing 2 is made up of two portions. One of the two portions is a fitting portion 4 provided for a mating male connector (not shown), and the other is an accommodating portion 5 provided for the male tab terminals 3.

The accommodating portion 5 includes a plurality of terminal accommodating chambers 6 which are arranged horizontally and vertically. In each of the terminal accommodating chambers 6, a flexible, locking lance 10 is formed on the upper inner wall 7 of the terminal accommodating chamber 6 in such a manner that it has a locking protrusion 9 which is adapted to engage with a middle shoulder 8 of the male tab terminal 3, and a male tab lead-out hole 14 is formed at the inner end of the terminal accommodating chamber 6; that is, in a partition wall 12 between the terminal accommodating chamber 6 and a mating connector fitting chamber 11. The male tab lead-out hole 14 is rectangular in section, and is to receive the front end portion of the male tab terminal 3, namely, a male tab 13.

In addition, a guide wall 16 is also formed at the inner end of each of the terminal accommodating chambers 6; that is, in the partition wall 12 in such a manner that its upper surface 16*a* is flush with the lower end 9*a* of the locking protrusion 9 of the locking lance 10. As a specific feature of the invention, a stripping groove 17 rectangular in section is formed in the lower end portion of each of the locking lances 10; i.e., in the middle of the locking protrusion 9 in such a manner that it is extended longitudinally of the terminal accommodating chamber, and in correspondence to the stripping groove 17, a guide prolongation 18 rectangular in section is formed on the upper surface 16*a* of the guide wall 16 in such a manner that it is extended longitudinally of the terminal accommodating chamber 6.

In each of the terminal accommodating chambers 6, the guide wall 16 and the guide prolongation 18 have a downwardly sloped surface 20 which is confronted with a terminal inserting opening 19. Furthermore, a stripping hole 21 is formed above the guide wall 16 and the guide prolongation 18 in correspondence to the locking lance 10.

The stripping groove 17, as was described above, is formed in the locking lance 10 in such a manner that it is extended longitudinally of the locking lance 10; however, it is not extended through the flexible base portion 10*a* of the locking lance 10, and therefore the formation of the stripping groove will not lower the elasticity of the locking lance 10. And it should be noted that the formation of the stripping groove 17 permits the provision of the guide prolongation 18.

Figure 3:
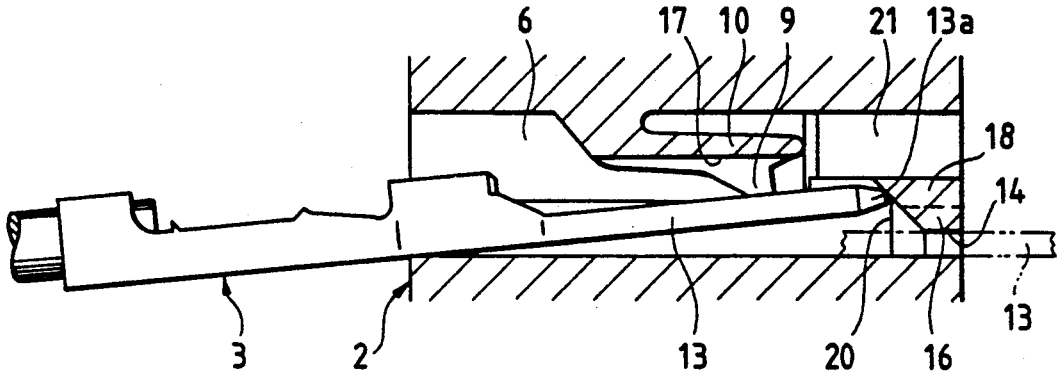
FIG. 3 is a longitudinal sectional view for a description of the function of the connector according to the invention.
Figure 4:
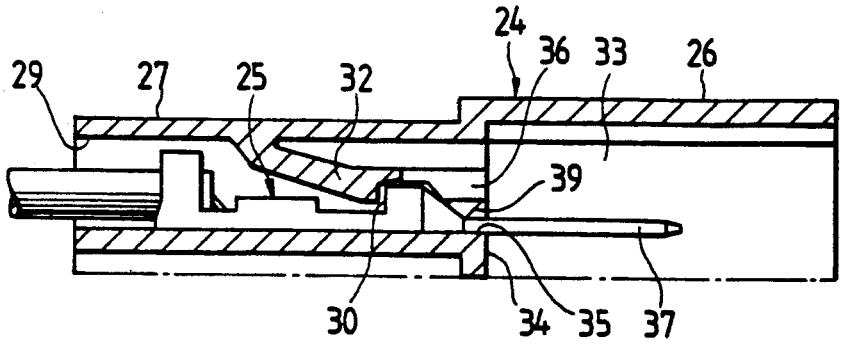
FIG. 4 PRIOR ART
FIG. 4 is a longitudinal sectional view showing a conventional connector.
Figure 5:
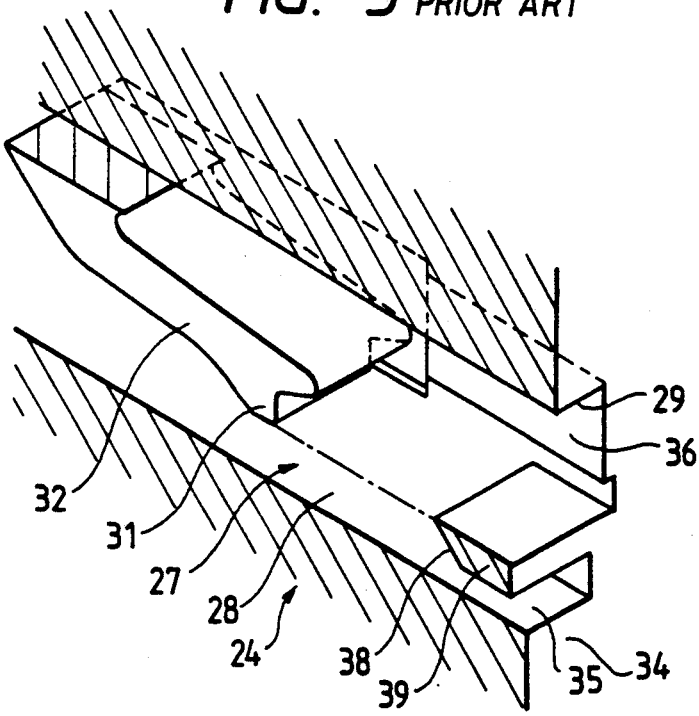
FIG. 5 PRIOR ART
FIG. 5 is a perspective view, with parts cut away, showing essential components of the conventional connector.
Figure 6:
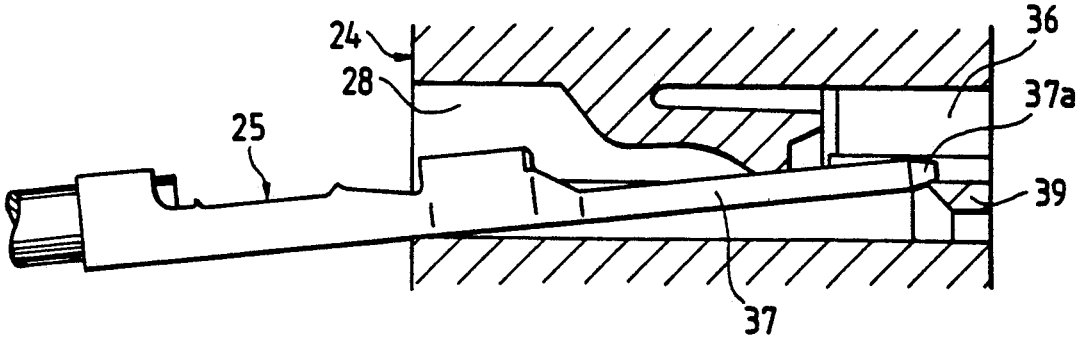
FIG. 6 PRIOR ART
FIG. 6 is a longitudinal sectional view for a description of the function of the conventional connector.

The function of the connector according to the invention will be described with reference to FIG. 3. Even if the male tab terminal 3 is obliquely inserted into the terminal accommodating chamber 6 as shown in FIG. 3, the end portion 13*a* of the male tab 13 abuts on the downwardly sloped surface 20 of the guide prolongation 18 which is raised high, so that it is smoothly guided into the male tab lead-out hole 14 as indicated by the two-dot chain lines 13.

Even if the male tab terminal 3 is more obliquely inserted into the terminal accommodating chamber 6, the male tab 13 is caused to abut on the protrusion 9 of the flexible locking lance 10, thus being pushed downwardly by the latter. As a result, the front end 13*a* of the male tab 13 abuts on the sloped surface 20 of the guide prolongation 18. Thus, the male tab terminal 3 is prevented from being incorrectly inserted into the terminal accommodating chamber.

The connector of the invention is applicable not only to the above-described male tab terminals but also to other terminals such as pin terminals.

As was described above, in the connector of the invention, in each of the terminal accommodating chambers the guide prolongation is formed in correspondence to the stripping groove of the flexible locking lance, so that even if the terminal is obliquely inserted into the terminal accommodating chamber, the end of the terminal is caused to abut on the guide prolongation, thus being smoothly guided into the lead-out hole. Hence, with the connector of the invention, the terminals are correctly inserted into the terminal accommodating chambers at all times, and the electrical connection is improved in reliability.

While the present invention has been described above with respect to preferred embodiments thereof, it should of course be understood that the present invention should not be limited only to these embodiments but various changes or modifications may be made without departure from the scope of the invention as defined by the appended claims.

What is claimed is:

1. A connector form by a molding comprising:

a connector housing (2) having a terminal accommodating chamber (6) provided at the inner end thereof with a stripping hole (21) for a flexible locking lance (10) and a lead-out hole (14) for receiving an end portion (13) of a terminal. (3) to be inserted into said connector housing (2);

a guide wall (16) provided between said stripping hole (21) and said lead-out hole (14) for guiding said terminal (3), said guide wall having a guide prolongation (18) protruded from said guide wall; and said flexible locking lance (10) for locking said terminal (3) at a predetermined position, said flexible locking lance (10) being protruded from an inner wall of said terminal accommodating chamber (6) formed in said connector housing (2), said flexible locking lance (10) being formed with a stripping groove (17) extended longitudinally of said flexible locking lance, and said guide prolongation (18) being formed in correspondence to said stripping groove (17).

2. A connector according to claim 1, in which said guide prolongation (18) has a downwardly sloped surface (20) for guiding said terminal downwardly so as to smoothly insert said end portion (13) of said terminal (3) into said lead-out hole (14).

3. A connector according to claim 1, in which said stripping groove (17) is shaped into a rectangular in section and said guide prolongation (18) is shaped into a rectangular in section.

* * * * *